US009481035B2

(12) United States Patent
Cooper

(10) Patent No.: US 9,481,035 B2
(45) **Date of Patent: *Nov. 1, 2016**

(54) IMMERSION HEATER FOR MOLTEN METAL

(71) Applicant: Molten Metal Equipment Innovations, LLC, Middlefield, OH (US)

(72) Inventor: Paul V. Cooper, Chesterland, OH (US)

(73) Assignee: Molten Metal Equipment Innovations, LLC, Middlefield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/804,157

(22) Filed: Jul. 20, 2015

(65) Prior Publication Data

US 2015/0323256 A1 Nov. 12, 2015

Related U.S. Application Data

(63) Continuation of application No. 12/880,027, filed on Sep. 10, 2010, now Pat. No. 9,108,244.

(60) Provisional application No. 61/241,349, filed on Sep. 10, 2009.

(51) Int. Cl.

| | |
|---|---|
| ***B22D 41/08*** | (2006.01) |
| ***B22D 41/015*** | (2006.01) |
| ***F27D 11/02*** | (2006.01) |
| ***F27D 99/00*** | (2010.01) |

(52) U.S. Cl.
CPC ..... *B22D 41/015* (2013.01); *F27D 11/02* (2013.01); *F27D 99/0006* (2013.01)

(58) Field of Classification Search
CPC ..... B22D 41/015; F27D 11/02
USPC ..... 266/242
See application file for complete search history.

(56) References Cited

U.S. PATENT DOCUMENTS

| | | | | |
|---|---|---|---|---|
| 4,125,146 | A | 11/1978 | Muller | |
| 9,108,244 | B2 * | 8/2015 | Cooper | B22D 41/015 |
| 9,193,532 | B2 | 11/2015 | March et al. | |
| 9,234,520 | B2 | 1/2016 | Morando | |
| 9,273,376 | B2 | 3/2016 | Lutes et al. | |
| 9,377,028 | B2 | 6/2016 | Cooper | |
| 9,382,599 | B2 | 7/2016 | Cooper | |
| 9,383,140 | B2 | 7/2016 | Cooper | |
| 9,409,232 | B2 | 8/2016 | Cooper | |
| 9,410,744 | B2 | 8/2016 | Cooper | |
| 9,422,942 | B2 | 8/2016 | Cooper | |
| 2002/0185790 | A1 | 12/2002 | Klingensmith | |
| 2010/0200354 | A1 | 8/2010 | Yagi et al. | |
| 2015/0069679 | A1 | 3/2015 | Henderson et al. | |

(Continued)

OTHER PUBLICATIONS

Notice of Allowance dated Jul. 7, 2016 in U.S. Appl. No. 14/662,100.

(Continued)

*Primary Examiner* — Scott Kastler
(74) *Attorney, Agent, or Firm* — Snell & Wilmer, L.L.P.

(57) ABSTRACT

The invention relates to a device for heating molten metal by the use of a heater that can be immersed into the molten metal. This immersion heater includes an outer cover formed of one or more materials resistant to the molten metal in which the immersion heater is to be used, and a heating element inside of the outer cover, where the heating element is protected from contacting the molten metal.

24 Claims, 9 Drawing Sheets

(56) References Cited

U.S. PATENT DOCUMENTS

| | | | |
|---|---|---|---|
| 2016/0116216 | A1 | 4/2016 | Schlicht et al. |
| 2016/0250686 | A1 | 9/2016 | Cooper |
| 2016/0265535 | A1 | 9/2016 | Cooper |

OTHER PUBLICATIONS

Notice of Allowance dated Jul. 20, 2016 in U.S. Appl. No. 14/715,435.
Final Office Action dated Jul. 28, 2016 in U.S. Appl. No. 13/800,460.
Office Action dated Aug. 1, 2016 in U.S. Appl. No. 15/153,735.
Office Action dated Aug. 15, 2016 in U.S. Appl. No. 14/811,655.
Office Action dated Aug. 17, 2016 in U.S. Appl. No. 14/959,758.
Final Office Action dated Aug. 10, 2016 in U.S. Appl. No. 12/853,238.
Final Office Action dated Aug. 26, 2016 in U.S. Appl. No. 14/923,296.
Office Action dated Aug. 29, 2016 in U.S. Appl. No. 14/687,806.
Final Office Action dated Sep. 15, 2016 in U.S. Appl. No. 14/745,845.
Office Action dated Sep. 15, 2016 in U.S. Appl. No. 14/746,593.
Office Action dated Sep. 22, 2016 in U.S. Appl. No. 13/841,594.

* cited by examiner

IMMERSION HEATER FOR MOLTEN METAL

CROSS-REFERENCE TO RELATED APPLICATIONS

This application is a continuation of, and claims priority to U.S. patent application Ser. No. 12/880,027 filed on Sep. 10, 2010, (Now U.S. Pat. No. 9,108,244 issued on Aug. 18, 2015), the disclosure of which is incorporated herein in its entity for all purposes. This application also claims priority to U.S. Provisional Application No. 61/241,349 filed on Sep. 10, 2009. The drawing figures and pages 14-16 of that application are incorporated herein by reference. This application also claims priority to and incorporates by reference U.S. application Ser. No. 12/878,984, filed on Sep. 9, 2010, (Now U.S. Pat. No. 8,524,146 issued on Sep. 3, 2013.

FIELD OF THE INVENTION

The invention relates to a system and device for heating molten metal.

BACKGROUND OF THE INVENTION

As used herein, the term "molten metal" means any metal or combination of metals in liquid form, such as aluminum, copper, iron, zinc, and alloys thereof. The term "gas" means any gas or combination of gases, including argon, nitrogen, chlorine, fluorine, Freon, and helium, which may be released into molten metal.

A reverbatory furnace is used to melt metal and retain the molten metal while the metal is in a molten state. The molten metal in the furnace is sometimes called the molten metal bath. Reverbatory furnaces usually include a chamber for retaining a molten metal pump and that chamber is sometimes referred to as the pump well.

Known pumps for pumping molten metal (also called "molten-metal pumps") include a pump base (also called a "base", "housing" or "casing") and a pump chamber (or "chamber" or "molten metal pump chamber"), which is an open area formed within the pump base. Such pumps also include one or more inlets in the pump base, an inlet being an opening to allow molten metal to enter the pump chamber.

A discharge is formed in the pump base and is a channel or conduit that communicates with the molten metal pump chamber, and leads from the pump chamber to the molten metal bath. A tangential discharge is a discharge formed at a tangent to the pump chamber. The discharge may also be axial, in which case the pump is called an axial pump. In an axial pump the pump chamber and discharge may be the essentially the same structure (or different areas of the same structure) since the molten metal entering the chamber is expelled directly through (usually directly above or below) the chamber.

A rotor, also called an impeller, is mounted in the pump chamber and is connected to a drive shaft. The drive shaft is typically a motor shaft coupled to a rotor shaft, wherein the motor shaft has two ends, one end being connected to a motor and the other end being coupled to the rotor shaft. The rotor shaft also has two ends, wherein one end is coupled to the motor shaft and the other end is connected to the rotor. Often, the rotor shaft is comprised of graphite, the motor shaft is comprised of steel, and the two are coupled by a coupling, which is usually comprised of steel.

As the motor turns the drive shaft, the drive shaft turns the rotor and the rotor pushes molten metal out of the pump chamber, through the discharge, which may be an axial or tangential discharge, and into the molten metal bath. Most molten metal pumps are gravity fed, wherein gravity forces molten metal through the inlet and into the pump chamber as the rotor pushes molten metal out of the pump chamber.

Molten metal pump casings and rotors usually, but not necessarily, employ a bearing system comprising ceramic rings wherein there are one or more rings on the rotor that align with rings in the pump chamber such as rings at the inlet (which is usually the opening in the housing at the top of the pump chamber and/or bottom of the pump chamber) when the rotor is placed in the pump chamber. The purpose of the bearing system is to reduce damage to the soft, graphite components, particularly the rotor and pump chamber wall, during pump operation. A known bearing system is described in U.S. Pat. No. 5,203,681 to Cooper, the disclosure of which is incorporated herein by reference. U.S. Pat. Nos. 5,951,243 and 6,093,000, each to Cooper, the disclosures of which are incorporated herein by reference, disclose, respectively, bearings that may be used with molten metal pumps and rigid coupling designs and a monolithic rotor. U.S. Pat. No. 2,948,524 to Sweeney et al., U.S. Pat. No. 4,169,584 to Mangalick, and U.S. Pat. No. 6,123,523 to Cooper (the disclosure of the afore-mentioned patent to Cooper is incorporated herein by reference) also disclose molten metal pump designs. U.S. Pat. No. 6,303,074 to Cooper, which is incorporated herein by reference, discloses a dual-flow rotor, wherein the rotor has at least one surface that pushes molten metal into the pump chamber.

The materials forming the molten metal pump components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of a charging well where scrap metal is charged (i.e., added).

Transfer pumps are generally used to transfer molten metal from the external well of a reverbatory furnace to a different location such as a launder, ladle, or another furnace. Examples of transfer pumps are disclosed in U.S. Pat. No. 6,345,964 B1 to Cooper, the disclosure of which is incorporated herein by reference, and U.S. Pat. No. 5,203,681.

Gas-release pumps, such as gas-injection pumps, circulate molten metal while releasing a gas into the molten metal. In the purification of molten metals, particularly aluminum, it is frequently desired to remove dissolved gases such as hydrogen, or dissolved metals, such as magnesium, from the molten metal. As is known by those skilled in the art, the removing of dissolved gas is known as "degassing" while the removal of magnesium is known as "demagging." Gas-release pumps may be used for either of these purposes or for any other application for which it is desirable to introduce gas into molten metal. Gas-release pumps generally include a gas-transfer conduit having a first end that is connected to a gas source and a second submerged in the molten metal bath. Gas is introduced into the first end of the gas-transfer conduit and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber. A system for releasing gas into a pump chamber is disclosed in U.S. Pat. No. 6,123,523 to Cooper. Furthermore, gas may be released into a stream of molten metal passing through a discharge or metal-transfer conduit wherein the position of a gas-release opening in the metal-transfer conduit enables pressure from the molten metal stream to assist in drawing gas into the molten metal stream. Such a structure and method is disclosed in U.S. application Ser. No. 10/773,101 entitled "System for Releasing Gas into Molten Metal", invented by Paul V. Cooper, and filed on Feb. 4, 2004, the disclosure of which is incorporated herein by reference.

Generally, a degasser (also called a rotary degasser) is used to remove gaseous impurities from molten metal. A degasser typically includes (1) an impeller shaft having a first end, a second end and a passage (or conduit) therethrough for transferring gas, (2) an impeller (also called a rotor), and (3) a drive source (which is typically a motor, such as a pneumatic motor) for rotating the impeller shaft and the impeller. The degasser impeller shaft is normally part of a drive shaft that includes the impeller shaft, a motor shaft and a coupling that couples the two shafts together. Gas is introduced into the motor shaft through a rotary union. Thus, the first end of the impeller shaft is connected to the drive source and to a gas source (preferably indirectly via the coupling and motor shaft). The second end of the impeller shaft is connected to the impeller, usually by a threaded connection. The gas is released from the end of the impeller shaft submersed in the molten metal bath, where it escapes under the impeller. Examples of rotary degassers are disclosed in U.S. Pat. No. 4,898,367 entitled "Dispersing Gas Into Molten Metal," U.S. Pat. No. 5,678,807 entitled "Rotary Degassers," and U.S. Pat. No. 6,689,310 to Cooper entitled "Molten Metal Degassing Device and Impellers Therefore," the respective disclosures of which are incorporated herein by reference.

In some applications, a heating system is desirable to heat the molten metal and maintain its temperature. Some conventional molten metal heating systems use a heating element to heat the air above the molten metal while other conventional systems heat the molten metal through induction by heating a wall of the vessel in which the molten metal is contained. But, a need exists for a system and device that provides a more efficient way to heat molten metal contained within a vessel.

SUMMARY OF THE INVENTION

The present invention is directed to systems and devices for heating molten metal contained within a vessel. A device according to the invention is an immersion heater, which means it is immersed into the molten metal, rather than heating the air above the molten metal or heating a side of the vessel in which the molten metal is contained.

The immersion heater includes an outer cover formed of one or more materials resistant to the molten metal in which the heater will be used and a heating element inside of the outer cover, wherein the heating element is protected from contacting the molten metal.

DETAILED DESCRIPTION OF PREFERRED EMBODIMENTS

Figure 1:
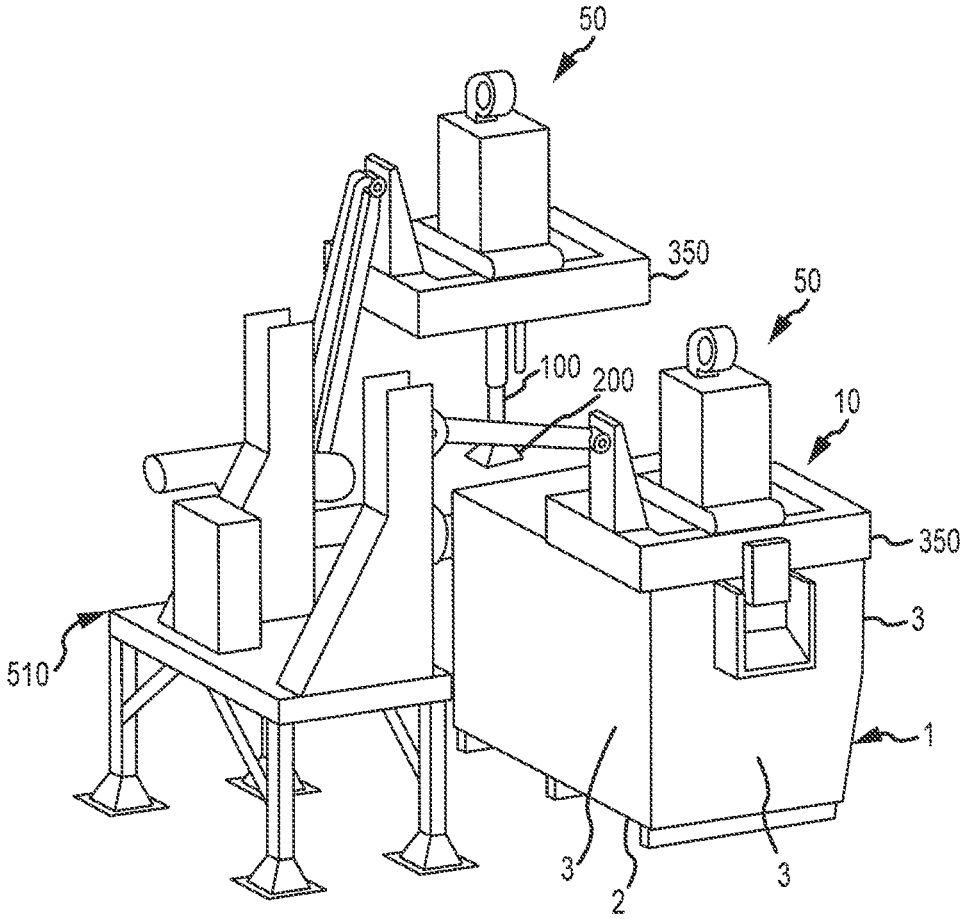
FIG. 1 is a perspective view of one embodiment of the invention.
Figure 2:
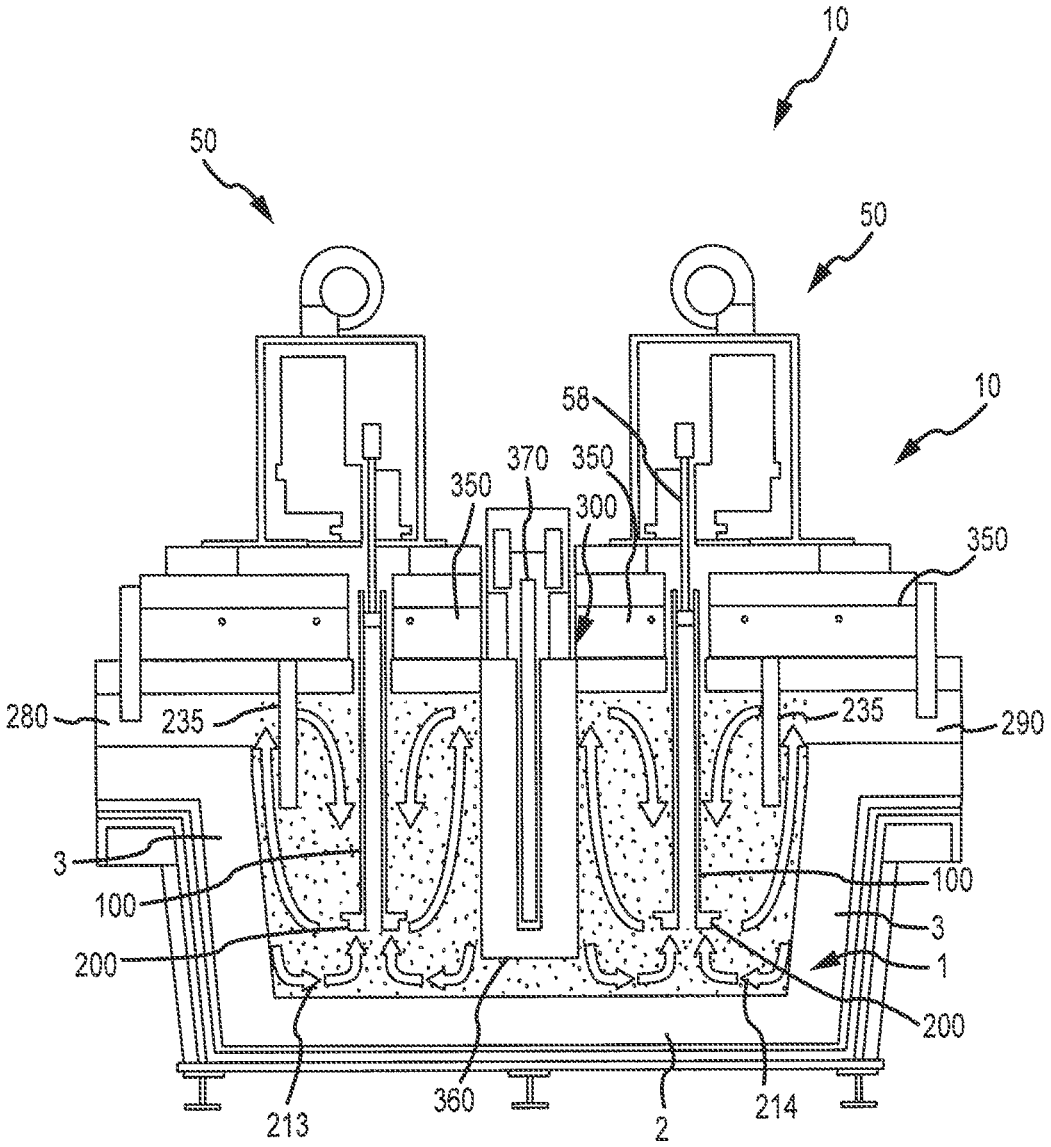
FIG. 2 is a side cut away view of the embodiment depicted in FIG. 1, illustrating, among other things, a flow of gas in the molten metal and immersion heater 300.

Reference will now be made to the present exemplary embodiments of the invention, examples of which are illustrated in the accompanying drawings. FIGS. 1 and 2 depict a system 10 according to the invention. The system 10 includes a vessel 1 for holding molten metal, having a lower wall 2 and side walls 3. The vessel 1 can be any suitable size, shape, and configuration.

The system 10 as shown includes one or more rotary degassers 50, each of which include a shaft 100 and an impeller 200. Shaft 100, impeller 200, and each of the impellers used in the practice of the invention, are preferably made of graphite impregnated with oxidation-resistant solution, although any material capable of being used in a molten metal bath, such as ceramic, could be used. Oxidation and erosion treatments for graphite parts are practiced commercially, and graphite so treated can be obtained from sources known to those skilled in the art.

If a rotary degasser is used with the invention, it may be any suitable type and exemplary rotary degassers are described in some of the documents already incorporated herein by reference.

The exemplary system 10 depicted in FIGS. 1 and 2 includes a pair of degassers 50 separated by an immersion heater 300. An immersion heater according to the invention has an outer cover 360 and one or more heating elements 370 (hereafter, "heating element") positioned within the outer cover 360. The outer cover 360 is comprised of heat-resistant material, such as refractory material (for example, ceramic or graphite) selected so that it can be placed into molten aluminum, molten zinc or other molten metals so that the material is suitable for the environment in which the invention will be used. The outer cover 360 has a cavity that retains the heating element 370, or the outer cover 360 can be formed around the heating element 370 (in a casting process, molding process or other suitable process) so that the outer cover 360 protects the heating element 370 and prevents it from contacting the molten metal when the immersion heater 300 is positioned in the molten metal. This enables heat to be applied directly from the heating element 370 through the outer cover 360 to virtually any portion of the molten metal bath, based on the shape and position of the immersion heater 300. Due to the heat generated by the heating element 370, the portion of the outer cover 360 that is in contact with the molten metal (which as shown are sides 360A and the ends of outer cover 360) can reach temperatures of, for example, 500° F.-1500° F., 500° F.-1200° F. or 500° F.-900° F., or any other suitable temperature depending upon the heating element, outer cover and type of molten metal.

The immersion heater 300 of the present invention is inserted into the molten metal and heats it directly, and is thus considerably more efficient than conventional molten metal heating systems, including those that heat the air above the molten metal.

The immersion heater 300 is preferably suspended and retained in place by a superstructure 380. Superstructure 380 as shown is a steel bar with bolts 382 that connect to the outer cover 360, but any suitable method or structure can be used to position an immersion heater 300 in a vessel.

As shown, the immersion heater 300 divides vessel 1 into two chambers (213 and 214). Here, each chamber defines a separate degassing zone and each chamber includes a degasser 20. The immersion heater 300 heats the molten metal in both chambers (213 and 214) within the vessel 1. A degassing system of the present invention may include any number of immersion heaters 300 of any suitable shape or size and any number of degassers 20. Any or all of the functions of each degasser 20, such as the speed of each impeller 200, may be independently controlled.

Figure 6:
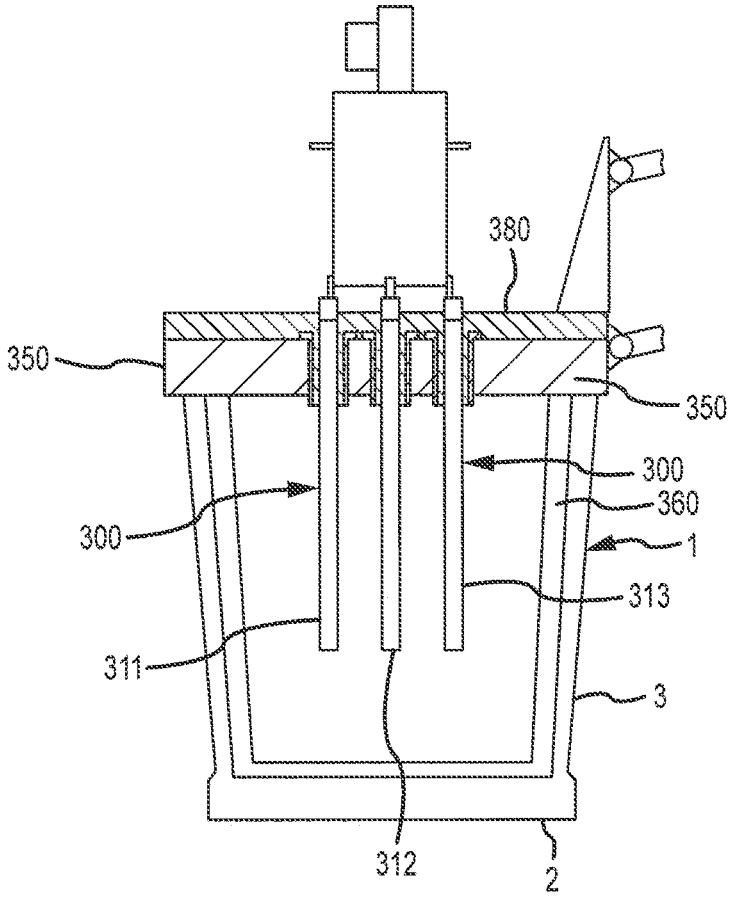
FIG. 6 depicts a side cut away view of an immersion heating element housed within a vessel according to one embodiment of the invention.

FIG. 6 depicts a side view of one embodiment of an immersion heater 300. In this embodiment, heater 300 includes three separate heating structures 311, 312, 313 that are approximately equally spaced apart. Heating structures 311, 312, 313 may be made from any suitable material and may be any suitable size, shape, and configuration, as previously described. While the heater 300 may be configured to provide any suitable amount of heat, the heater in the present exemplary embodiment can produce about 30 kW of heat. An immersion heater 300 of the present invention may include any number of individual heating elements.

Figure 7:
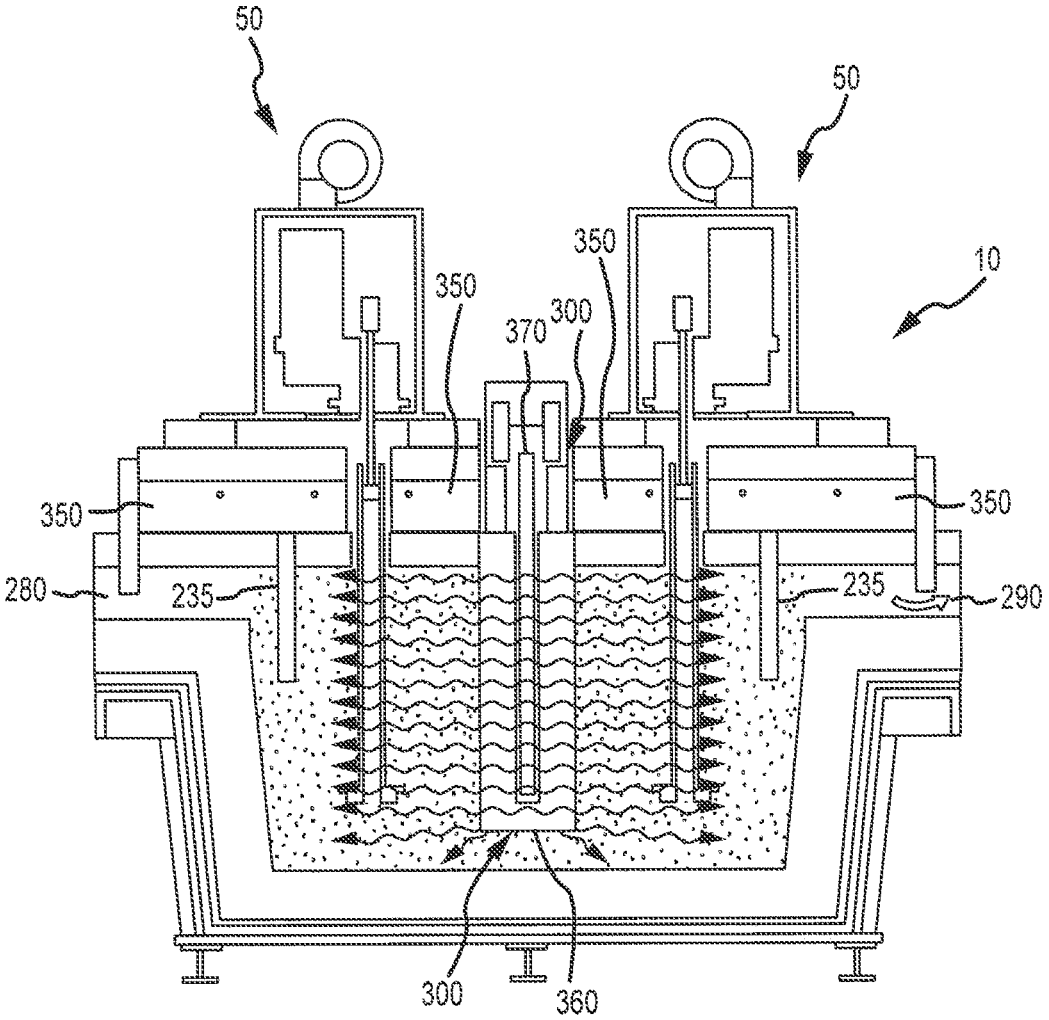
FIG. 7 is side cut away view of one embodiment of the invention depicting the heat radiating from an immersion heating element.
Figure 8:
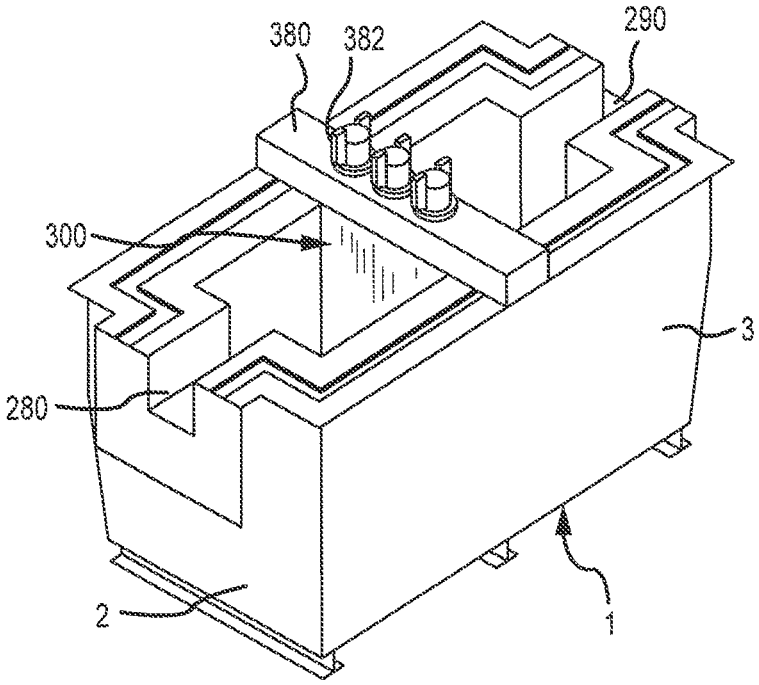
FIG. 8 is a perspective view of one embodiment of the invention.

The temperature of each heating structure 311, 312, 313, may be independently controlled or controlled as a group in any suitable manner. In one exemplary embodiment, each element is controlled by a full-proportioning silicon controlled rectifier (SCR) power controller, which can help prevent the heating element 300 from overheating, resulting in a longer service life. While the heater 300 may be formed from any suitable materials, in the present exemplary embodiment each heating structure comprises a graphite or silicon carbide outer cover 360 in which the individual heating elements are positioned. The shaded arrows in FIG. 7 illustrate how the heating element 300 of the present invention can provide heat to the molten metal within the vessel 1, including both chambers 213, 214 simultaneously.

In one embodiment the heating elements 311, 312, 313 may be controlled by an optional control system. This control system may be operated and controlled by a user and/or software. The heating elements 311, 312, 313 may be individually controlled. The system 10 may also include one or more temperature sensors which directly or indirectly measure the temperature of the molten metal and/or components of the system 10. The measured temperatures may be used with the computerized control system to achieve a desired temperature of the molten metal. Also, these measured temperatures may be used to diagnose potential problems with the components of the system 10.

A degassing pattern provided by the rotor 200 according to one embodiment of the invention is depicted by the shaded arrows in FIG. 2. In this example, the rotor 200 of each degasser circulates the molten metal while dispersing gas (depicted in the drawings as bubbles) into the molten metal. In this manner, the molten metal in each chamber (213, 214) is mixed with the gas.

Additionally, the system 10 may include one or more dividers 235 to help redirect the flow of gas mixed with molten metal. Dividers 235 may be of any suitable size and be made out of any suitable material for use in the molten metal bath. In the preferred embodiment, the dividers 235 are made from refractory materials such as graphite and/or ceramic. The dividers 235, vessel 1, and immersion heater 300 may be sized, shaped, and configured in any desired manner to achieve a desired flow pattern of the molten metal and/or gas.

Figure 3:
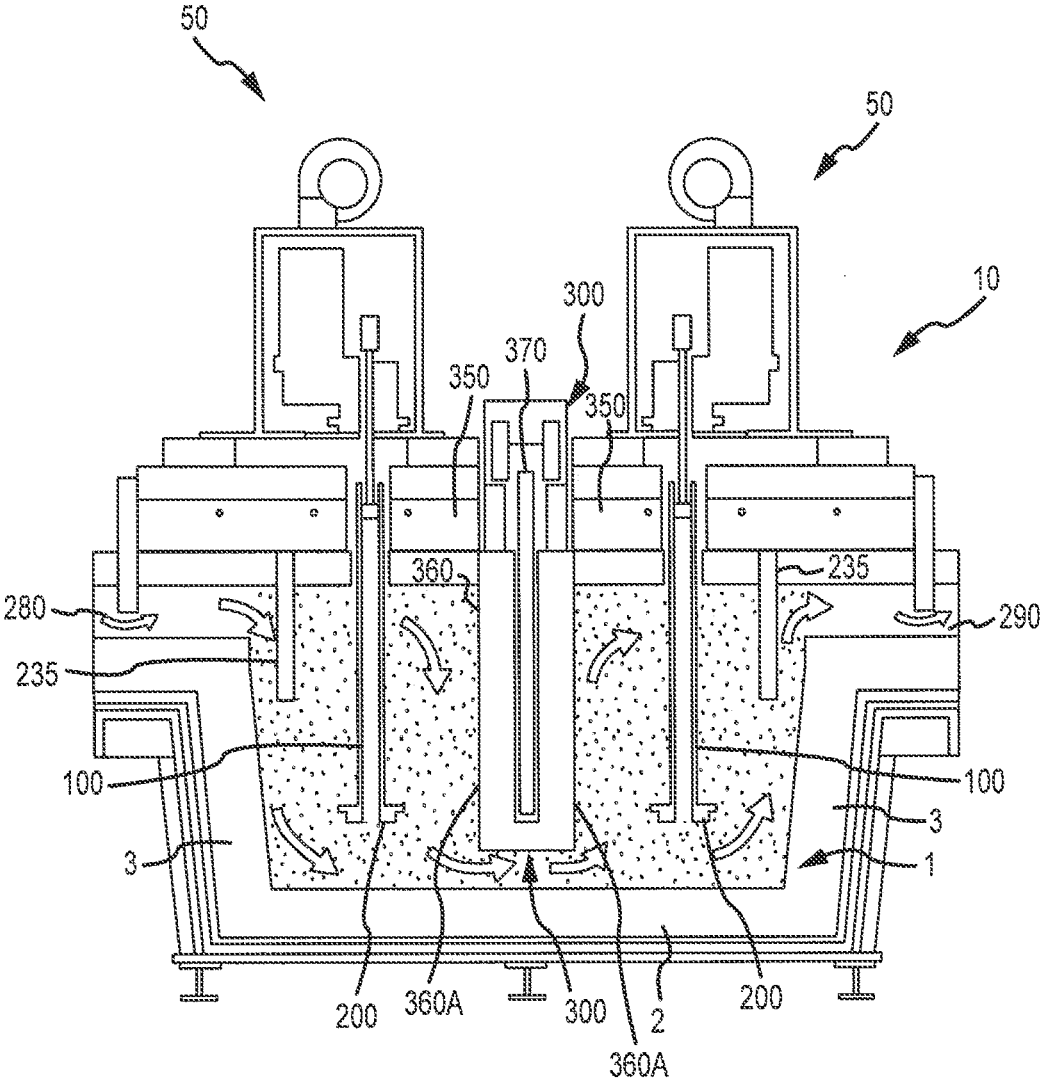
FIG. 3 is a side cut away view of the embodiment depicted in FIGS. 1 and 2, illustrating a flow of molten metal.
Figure 4:
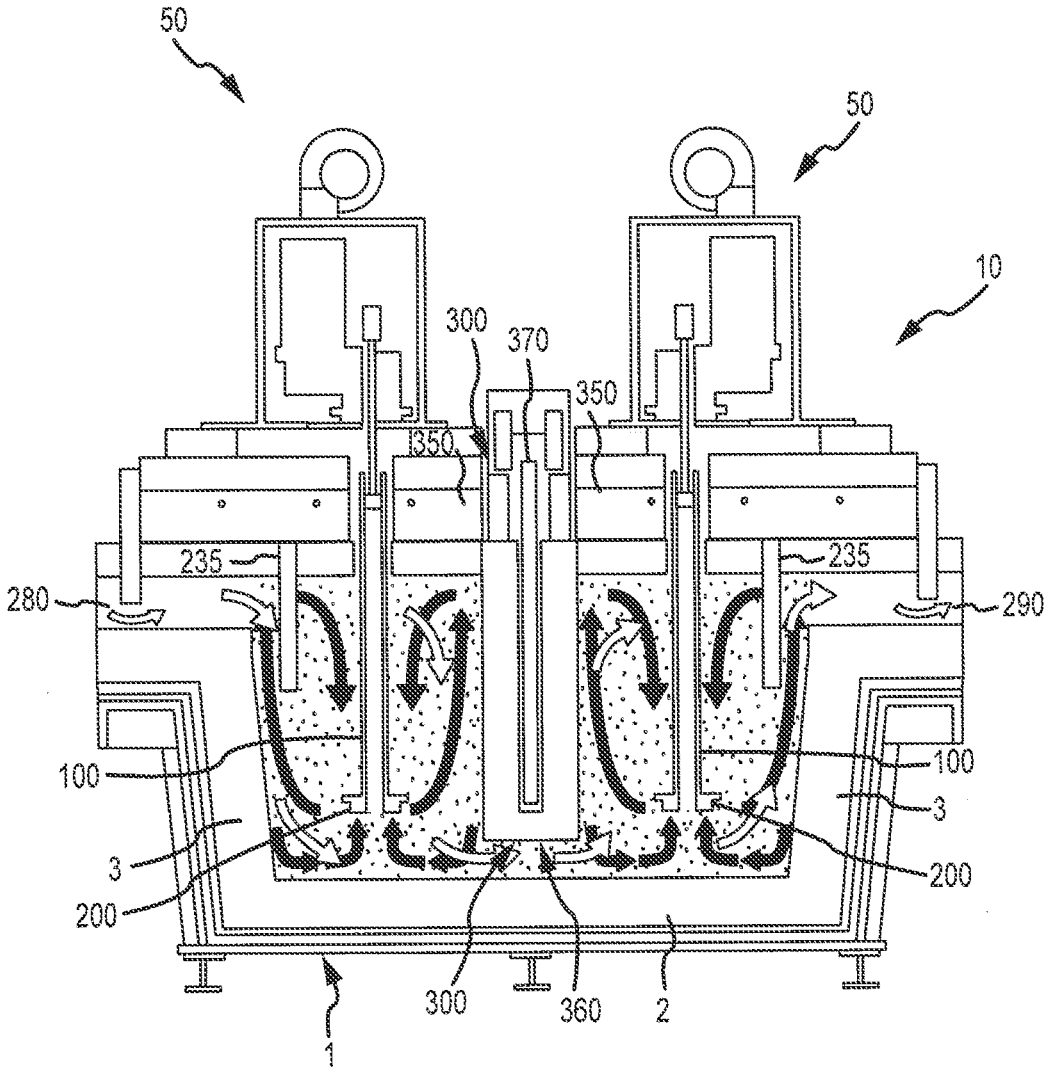
FIG. 4 is a side cut away view of the embodiment depicted in FIGS. 1, 2, and 3 illustrating both a flow of molten and a flow of gas.

Although any suitable flow pattern may be implemented in the present invention, the shaded arrows in FIG. 3 depict one preferred flow pattern of molten metal through vessel 1. Molten metal is introduced to vessel 1 through inlet 280. Inlet 280 is in fluid communication with outlet 290. The arrows of FIG. 3 depict one flow pattern on molten metal from the inlet 280 through the vessel 1 to the outlet 290. This metal flow pattern helps to thoroughly disperse gas into the molten metal passing through the system 10. The shaded arrows in FIG. 4 depict the combined flow pattern of the molten metal and the degassing patterns of FIGS. 2 and 3. The darker arrows represent the degassing pattern, while the lighter arrows represent the metal flow pattern.

Figure 5A:
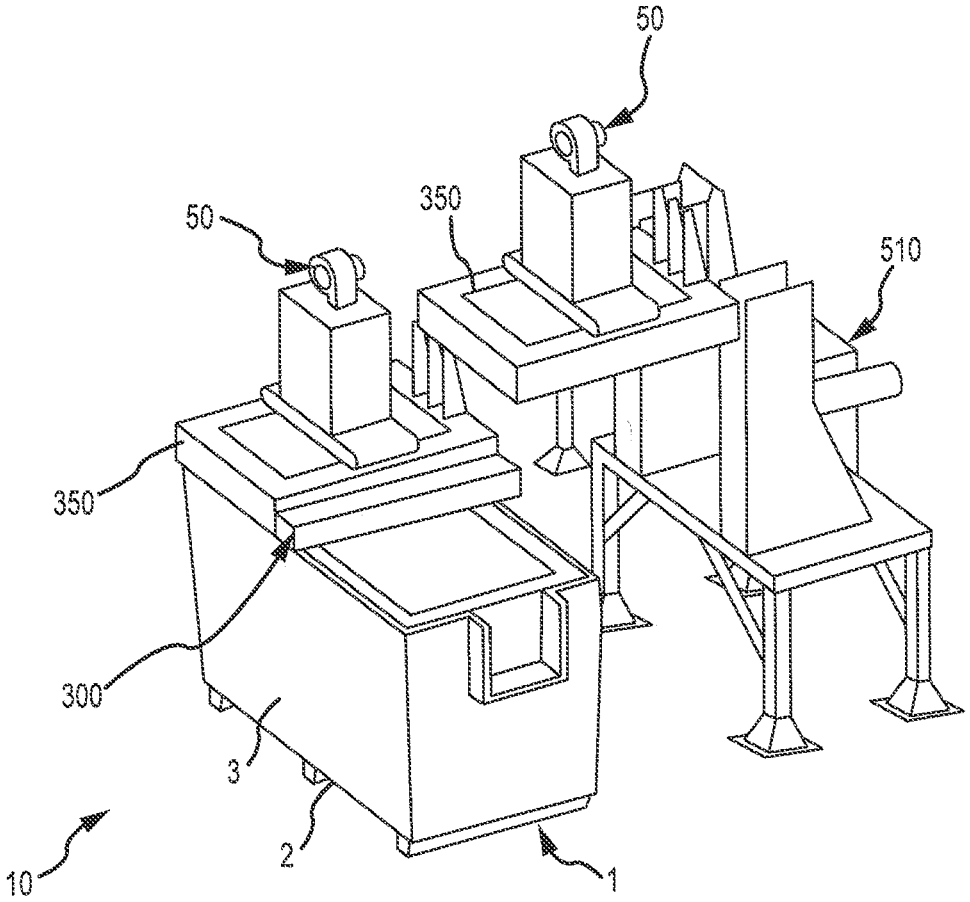
FIG. 5A is a perspective view of another embodiment of the invention depicting exemplary lifting mechanisms.
Figure 5B:
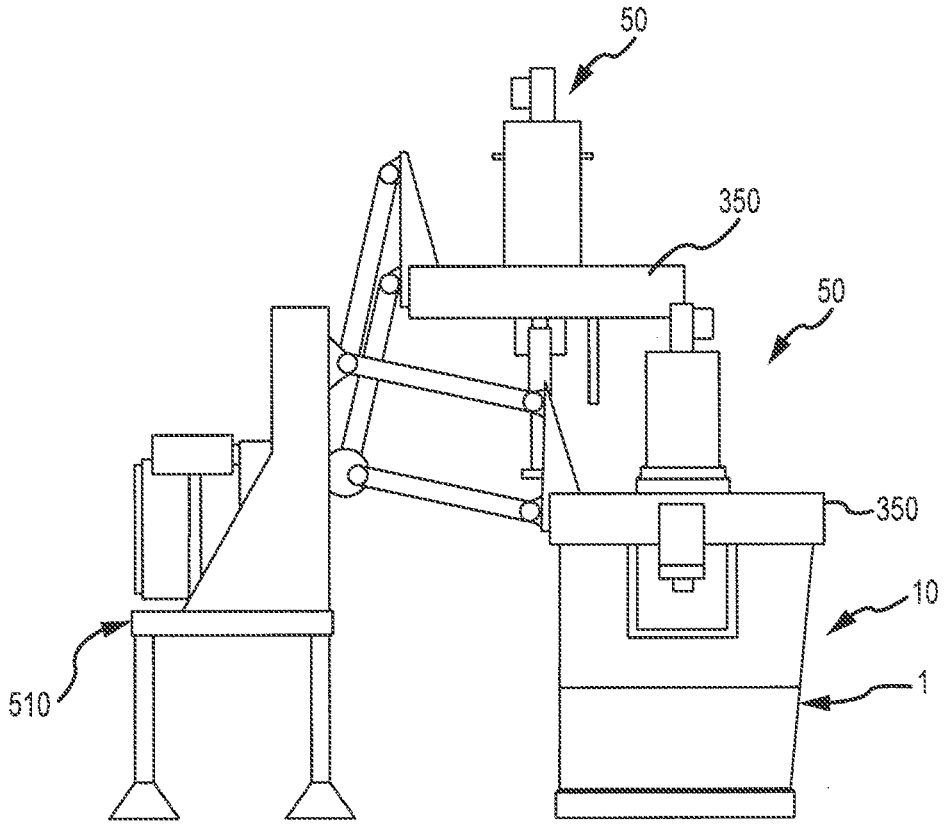
FIG. 5B is a side view of the embodiment depicted in FIG. 5A in the up, or lifted, position.

FIGS. 5A and 5B illustrate another view of the present invention wherein each degasser 20 is coupled to a removable cover 350 that can be independently positioned onto, or removed from, the vessel 1. A cover 350 operating in conjunction with the present invention may be any suitable size, shape, and configuration, and may be formed from any suitable material(s). In the present embodiment, each cover 350 is encased in steel and insulated to help retain heat. Also, the cover 350 at least partially maintains an inert gas environment when it is in position on the vessel 1.

In this exemplary embodiment, in its first position, each cover 350 is positioned to help retain gas and heat. Weirs (not shown) at the inlet 280 and outlet 290 likewise help retain gas and heat within the vessel 1.

Each cover 350 may be independently moved from a first position on the top surface of vessel 1 (i.e., the cover 350 in the background of FIG. 5A) to a second position removed from the vessel 1 (i.e., the cover 350 in the foreground of FIG. 5A). Cover 350 may be manually positioned or removed, but the present exemplary embodiment utilizes a lifting mechanism 510. The lifting mechanism 510 may include any suitable system, structure, or device to manipulate the cover 350. Through use of the removable cover 350 and the lifting mechanism 510, components of the system 10, such as the heating element 300, shaft 100 and rotor 200 may be easily accessed, replaced and/or cleaned. In one embodiment, the lifting mechanism 510 includes a gear-driven 4-bar linkage.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A device comprising:

a vessel for containing molten metal, the vessel having a length, a width, a top surface, a first chamber and a second chamber;

a plurality of immersion heaters positioned in line across the width of the vessel, each of the plurality of immersion heaters comprising an outer cover of material resistant to molten metal and a heating element inside of the outer cover, the heating element connectable to an energy source, the outer cover comprised of a material formulated to be resistant to the molten metal, wherein the outer cover protects the heating element from contacting the molten metal when the immersion heater is positioned in the molten metal; and wherein the plurality of immersion heaters divides the vessel into the first chamber and the second chamber and there is at least one rotary degasser in either the first chamber or the second chamber.

2. The device of claim 1, wherein the energy source of each heating element is a source of electricity.

3. The device of claim 1, wherein each heating element is one or more wire coils.

4. The device of claim 1, wherein each immersion heater is rectangular.

5. The device of claim 1, wherein each outer cover is comprised of one or more of graphite and ceramic.

6. The device of 1, wherein each outer cover is molded over each heating element.

7. The device of claim 1, wherein each outer cover has a cavity and the heating element corresponding to each outer cover is positioned in the cavity.

8. The device of claim 1, wherein the vessel has a top surface and further comprises one or more insulated covers to cover a portion of the top surface of the vessel.

9. The device of claim 8, wherein at least one of the one or more of the insulated covers has a first position where it is attached to the vessel and covers a portion of the top surface of the vessel and a second position wherein it is attached to the vessel and does not cover a portion of the top surface of the vessel.

10. The device of claim 8, wherein the device comprises a plurality of insulated covers.

11. The device of claim 1, that includes a plurality of degassers, wherein each of the degassers is positioned in the vessel.

12. The device of claim 1, wherein molten metal flows from the first chamber to the second chamber during use.

13. The device of claim 1, wherein the device further comprises an inlet in the first chamber in fluid communication with the vessel.

14. The device of claim 13, wherein the device further comprises an outlet in the second chamber in fluid communication with the vessel.

15. The device of claim 1, wherein the bottom surface of each immersion heater is positioned above a bottom surface of the vessel.

16. The device of claim 1, wherein the outer cover is comprised of a refractory material.

17. The device of claim 1 that further includes a superstructure at the top of the vessel and the immersion heater is suspended from the superstructure.

18. The device of claim 17, wherein the superstructure includes a metal bar and bolts extend from the metal bar into the outer cover.

19. The device of claim 1, wherein the outer cover is comprised of one or more of the group consisting of graphite and ceramic.

20. The device of claim 1, wherein each of the plurality of immersion heaters is connected to a control that controls the temperature of each of the immersion heaters.

21. The device of claim 1, wherein each immersion heater includes a silicon controlled rectifier power controller to help prevent the immersion heater from overheating.

22. The device of claim 1, wherein each rotary degasser has a shaft that extends into the molten metal, and the shaft of each rotary degasser is the same distance from the plurality of immersion heaters.

23. The device of claim 1 that further includes a first baffle inside of the vessel, downstream of the inlet and upstream of the plurality of immersion heaters, the first baffle for directing molten metal entering the vessel downward.

24. The device of claim 23 that further includes a second baffle inside of the vessel, the second baffle downstream of the first baffle, downstream of the plurality of immersion heaters and upstream of the outlet, the second baffle for helping to prevent molten metal at the surface of the molten metal contained within the vessel from exiting the outlet.

* * * * *